US009884740B2

(12) United States Patent
Mishima et al.

(10) Patent No.: US 9,884,740 B2
(45) Date of Patent: Feb. 6, 2018

(54) FIBER BUNDLE WITH PIECED PART, PROCESS FOR PRODUCING SAME, AND PROCESS FOR PRODUCING CARBON FIBER

(71) Applicant: Toray Industries, Inc., Tokyo (JP)

(72) Inventors: Kunihiro Mishima, Otsu (JP); Takamitsu Hirose, Ehime (JP); Kimiyasu Kato, Otsu (JP); Mitsutoshi Ozaki, Nomi (JP); Daiki Watanabe, Ehime (JP)

(73) Assignee: Toray Industries, Inc., Tokyo (JP)

( * ) Notice: Subject to any disclaimer, the term of this patent is extended or adjusted under 35 U.S.C. 154(b) by 352 days.

(21) Appl. No.: 14/697,666

(22) Filed: Apr. 28, 2015

(65) Prior Publication Data

US 2015/0233024 A1 Aug. 20, 2015

Related U.S. Application Data

(62) Division of application No. 13/127,620, filed as application No. PCT/JP2009/069032 on Nov. 9, 2009, now abandoned.

(51) Int. Cl.

*B65H 69/06* (2006.01)
*D02J 1/08* (2006.01)
*D01F 9/14* (2006.01)

(52) U.S. Cl.

CPC ..... *B65H 69/061* (2013.01); *D02J 1/08* (2013.01); *B65H 2701/314* (2013.01); *D01F 9/14* (2013.01)

(58) Field of Classification Search

CPC .. B65H 69/061; B65H 69/046; B65H 69/066; B65H 69/06; D02J 1/08; D02J 1/02;
(Continued)

(56) References Cited

U.S. PATENT DOCUMENTS 3,306,020 A * 2/1967 Rosenstein ..... B60C 9/0042 57/202
3,339,362 A * 9/1967 Dodson, Jr. ..... B65H 69/061 57/22

(Continued)

FOREIGN PATENT DOCUMENTS

JP 54055624 5/1979
JP 06206667 7/1994

(Continued)

OTHER PUBLICATIONS

Entire patent prosecution history of U.S. Appl. No. 13/127,620, filed, May 4, 2011, entitled, "Fiber Bundle with Pieced Part, Process for Producing Same, and Process for Producing Carbon Fiber.".

(Continued)

*Primary Examiner* — Amy Vanatta
(74) *Attorney, Agent, or Firm* — RatnerPrestia

(57) ABSTRACT

A fiber bundle which has a pieced part formed by jetting a pressurized fluid against a fiber-bundle overlap is formed either by directly superposing the ending part of a fiber bundle composed of many fibers on the beginning part of another fiber bundle composed of many fibers or by superposing the end part and the beginning part on a jointing fiber bundle composed of many fibers, whereby the many fibers of the fiber bundles are interlaced with one another to thereby piece up the fiber bundles. The pieced part comprises an opened-fiber part in which the fibers have been opened and interlaced-fiber parts respectively located on both sides thereof, each interlaced-fiber part being composed of a plurality of constituent interlaced parts located apart in the width direction for the fiber bundle.

9 Claims, 3 Drawing Sheets

(58) Field of Classification Search
CPC .. D02J 1/06; D02G 1/16; D02G 1/162; D02G 1/165; D02G 1/008; D02G 1/164
USPC ..... 28/209, 210, 252, 271; 57/22, 23
See application file for complete search history.

(56) References Cited

U.S. PATENT DOCUMENTS

| | | | | |
|---|---|---|---|---|
| 3,458,905 | A * | 8/1969 | Dodson, Jr. | B65H 69/066 28/104 |
| 4,069,565 | A * | 1/1978 | Negishi | D02J 1/08 28/272 |
| 4,152,886 | A * | 5/1979 | Nelson | D02G 3/34 28/252 |
| 4,466,949 | A * | 8/1984 | Mori | B65H 69/061 264/29.2 |
| 4,803,762 | A * | 2/1989 | Sheehan | B65H 69/061 156/158 |
| 5,056,200 | A * | 10/1991 | Schwartz | D02G 1/162 28/252 |
| 6,485,592 | B1 | 11/2002 | Yoshimura | |
| 7,941,903 | B2 * | 5/2011 | Ikeda | D01F 9/14 28/271 |
| 9,528,199 | B2 * | 12/2016 | Journee | D02G 1/16 |
| 2004/0168425 | A1 * | 9/2004 | Kawamura | B65H 69/061 57/22 |
| 2009/0139197 | A1 * | 6/2009 | Sikula | B65H 69/061 57/22 |

FOREIGN PATENT DOCUMENTS

| | | |
|---|---|---|
| JP | 10226918 | 8/1998 |
| JP | 11124741 | 5/1999 |
| JP | 2000144534 | 5/2000 |
| JP | 2007046177 | 2/2007 |
| JP | 2008094539 | 4/2008 |

OTHER PUBLICATIONS

International Preliminary Report on Patentability and Written Opinion for International Application No. PCT/JP2009/069032 dated Jun. 21, 2011.

International Search Report for International Application No. PCT/JP2009/069032 dated Dec. 8, 2009.

* cited by examiner

FIBER BUNDLE WITH PIECED PART, PROCESS FOR PRODUCING SAME, AND PROCESS FOR PRODUCING CARBON FIBER

CROSS-REFERENCE TO RELATED APPLICATIONS

This application is a divisional patent application of U.S. patent application Ser. No. 13/127,620, filed May 4, 2011, which is a U.S. National Phase patent application of International Patent Application No. PCT/JP2009/069032, filed Nov. 9, 2009, which claims priority to Japanese Patent Application No. 2009-085793, filed Mar. 31, 2009, which claims priority to Japanese Patent Application No. 2008-287519, filed Nov. 10, 2008, each of which is incorporated by reference herein in its entirety.

FIELD OF THE INVENTION

The invention relates to a fiber bundle having a fiber joint portion, a production method thereof, and a carbon fiber production method. When carbon fiber is produced from precursor fiber bundles designed for carbon fiber produce, it is sometimes necessary to continue supplying such precursor fiber bundles to a carbon fiber production process for a long period of time. In such cases, it is necessary to join the tail end portion of a precursor fiber bundle for carbon fiber production with the front end portion of another precursor fiber bundle for carbon fiber production to produce a continuous precursor fiber bundle. A fiber-joint-portion-containing fiber bundle according to the invention can be used effectively for such production of a continuous precursor fiber bundle.

BACKGROUND OF THE INVENTION

In general, precursor fiber bundles specially designed for carbon fiber production are used in carbon fiber production processes. These precursor fiber bundles are commonly wound up on a bobbin or folded and stored in boxes in the precursor fiber bundle supply equipment. Precursor fiber bundles pulled out of the precursor fiber bundle supply equipment are commonly supplied to a calcination step that comprises an oxidizing step and a carbonizing step.

To continue the calcination of precursor fiber bundles for a long period of time to continue carbon fiber production for a long period of time, therefore, the front end portion of the precursor fiber bundle pulled out from the precursor fiber bundle supply equipment has to be joined by some means with the tail end portion of the precursor fiber bundle that is passing through the calcination step. By joining the end portions of these precursor fiber bundles in their length direction, it becomes possible to supply the precursor fiber bundles continuously to the carbon fiber production process, consequently leading to improvement of the operation of the process.

There is a known method in which length-directional end portions of respective two polyacrylonitrile-based precursor fiber bundles, which are used as precursor fiber bundles for carbon fiber production, are joined by applying pressurized fluid jets to interlace the fibers (see Patent Literature 1).

However, though it is actually possible to join the end portions of precursor fiber bundles by this method, the fiber density will be too high in the fiber joint portion formed, giving rise to the problem of runaway of the oxidization reaction caused during the oxidizing step by the heat generated from the precursor fiber bundles themselves. Accordingly, there have been accidents involving thermal destruction and burnout of the fiber joint portion. To prevent the breakage of the fiber joint portion from being caused by heat accumulation, there is the means of lowering the temperature of the oxidizing step. If the temperature of the oxidizing step is lowered significantly, however, a longer time will be required for carrying out the oxidizing step, leading to a considerable decrease in the productivity for the desired carbon fibers.

If the precursor fiber bundles are composed of a large number of filaments, the pressurized fluid jets emitted from jetting nozzles will not be able to cover the entire precursor fiber bundles, and the precursor fiber bundles will not be interlaced at the filament level, but instead divided into sub-bundles that are interlaced. If such sub-bundles are formed unevenly in the fiber joint portion, the fiber density will increase locally to accelerate heat accumulation. In addition, sufficient interlacement will not be achieved in the fiber joint portion, leading to a smaller binding strength between the precursor fiber bundles. As a result, the fiber bundles will become unable to resist the tension caused during the process, leading to rupture or slippage of the bundles in the fiber joint portion.

For instance, as a known solution to this problem, two polyacrylonitrile-based precursor fiber bundles may be joined by means of a connection medium (joint fiber bundle) composed of oxidized fibers that do not generate heat (see Patent Literature 2). Though this method can reduce the quantity of heat accumulation, however, the heat in the joint portion cannot be removed sufficiently, and breakage of the yarn may still occur easily in the joint portion where the fiber density has increased.

Therefore, the furnace temperature has to be decreased as the fiber joint portion passes through the oxidizing step. In addition, the oxidized fibers that constitute the joint fiber bundle and the fibers that constitute the polyacrylonitrile-based precursor fiber bundle are different in the way they are unraveled in their respective bundles, and accordingly, the fibers that constitute the polyacrylonitrile-based precursor fiber bundle and the oxidized fibers that constitute the joint fiber bundle are not commingled sufficiently and fail to be interlaced uniformly. This can cause slippage of these fiber bundles, leading to forced shutdown of the oxidizing furnace for fire prevention purposes.

There is another known method in which instead of interlacement and joining achieved by pressurized air, the fiber bundles are divided into several sub-bundles in their end portions, and joined by braiding the sub-bundles together (see Patent Literature 3). In this case, the joined bundles form nodes, which are tightened to increase the fiber density in the joint portion, leading to heat accumulation that causes breakage of the yarn. Furthermore, there will be a large variation in the binding strength among the sub-bundles in the joint portion, and a stress is concentrated on those sub-bundles with a smaller binding strength, causing breakage of the sub-bundles starting with those with a smaller binding strength.

In addition, there is a proposal of polyacrylonitrile-based fiber bundles for carbon fiber production that are produced by oxidizing the end portions of precursor fiber bundles to form oxidized fiber bundles having a density of 1.30 g/cm$^3$ or more, and joining together precursor fiber bundles with such end portions by interlacing and integrating the fibers in the end portions to form a joint portion (see Patent Literature 4). In this case, though breakage of the yarn due to heat accumulation in the joint portion tends to be reduced, a special apparatus is required to make the end portions of the precursor fiber bundles to oxidized fibers, leading to a lower productivity.

PATENT LITERATURE

Patent Literature 1: JP 06-206667 A
Patent Literature 2: JP 10-226918 A
Patent Literature 3: JP 2007-046177 A
Patent Literature 4: JP 2000-144534 A

SUMMARY OF THE INVENTION

The invention aims to provide a fiber bundle having a fiber joint portion that serves to solve the problems in the prior art, and a production method thereof. The invention also aims to provide a method to produce carbon fiber from a fiber-joint-portion-containing fiber bundle according to the invention, wherein the fiber joint portion does not suffer significant heat accumulation, and the fiber joint portion does not suffer burnout due to heat accumulation during a calcination step, and that the fiber bundle can pass the production process smoothly.

A fiber-joint-portion-containing fiber bundle according to embodiments of the invention is described below.

A fiber bundle is provided having a fiber joint portion comprising either a superposed fiber bundle portion in which one end portion of a first fiber bundle of multiple fibers and one end portion of a second fiber bundle of multiple fibers are superposed or two superposed fiber bundle portions formed in a joint fiber bundle where one end portion of a first fiber bundle of multiple fibers and one end portion of a second fiber bundle of multiple fibers are respectively superposed on said joint fiber bundle wherein each of said superposed fiber bundle portions comprises two or more interlaced fiber portions in which said fibers are interlaced and that are located apart from each other in the length direction of the fiber bundles, and an unraveled fiber portion in which said fibers are unraveled and that is located between said two or more interlaced fiber portions, and in addition, each of said interlaced fiber portions comprises two or more interlaced sub-portions composed of said multiple fibers of one fiber bundle interlaced with said multiple fibers of the other fiber bundle in said superposed fiber bundle portion and located at intervals in the width direction of said fiber bundles, so that said two or more interlaced fiber portions act to join said fiber bundles in said superposed fiber bundle portion.

For the fiber-joint-portion-containing fiber bundle according to an embodiment of the invention, it is preferable that both said first fiber bundle and said second fiber bundle are precursor fiber bundles designed for carbon fiber production.

For the fiber-joint-portion-containing fiber bundle according to an embodiment of the invention, it is preferable that said joint fiber bundle has a heat conductivity of 3 to 700 W/m·K.

For the fiber-joint-portion-containing fiber bundle according to an embodiment of the invention, it is preferable that said joint fiber bundle is a carbon fiber bundle having a drape value of 2 to 15 cm and a flatness of 20 or more.

For the fiber-joint-portion-containing fiber bundle according to an embodiment of the invention, it is preferable that the fineness of said joint fiber bundle is 0.2 to 3.0 times that of said first fiber bundle and that of said second fiber bundle.

For the fiber-joint-portion-containing fiber bundle according to an embodiment of the invention, it is preferable that the tensile strength of said fiber joint portion is 20 g/tex or more at room temperature.

For the fiber-joint-portion-containing fiber bundle according to an embodiment of the invention, it is preferable that the length of each of the interlaced fiber portions is 8 to 30 mm in the length direction of said fiber bundle and that the length of said unraveled fiber portion is 30 to 100 mm in the length direction of said fiber bundle.

A production method for the fiber-joint-portion-containing fiber bundle according to an embodiment of the invention is as described below.

A production method is provided for a fiber bundle having a fiber joint portion comprising applying a pressurized fluid emitted from a fiber interlacing apparatus to each of superposed fiber bundle portions in a fiber bundle that has either a superposed fiber bundle portion in which one end portion of a first fiber bundle of multiple fibers and one end portion of a second fiber bundle of multiple fibers are superposed or two superposed fiber bundle portions formed in a joint fiber bundle where one end portion of a first fiber bundle of multiple fibers and one end portion of a second fiber bundle of multiple fibers are respectively superposed on said joint fiber bundle, so that said fibers are interlaced with each other to join said fiber bundles in said superposed fiber bundle portions; wherein said fiber interlacing apparatus comprises a first fluid jetting hole series comprising a plurality of fluid jetting holes aligned at intervals along a first line in the width direction of said fiber bundles and a second fluid jetting hole series comprising a plurality of fluid jetting holes aligned at intervals along a second line that is parallel to the first line and that is positioned with an interval in the length direction of said fiber bundles to the first line, and works to emit pressurized fluid jets from said plurality of fluid jetting holes of said first fluid jetting hole series and said plurality of fluid jetting holes of said second fluid jetting hole series to produce, in said superposed fiber bundle portion, two or more interlaced fiber portions in which said fibers are interlaced and that are located at intervals in the length direction of the fiber bundles and unraveled fiber portions in which said fibers are unraveled and that are located between said two or more interlaced fiber portions, in such a manner that each of said interlaced fiber portions is composed of two or more interlaced sub-portions that are composed of said multiple fibers of one fiber bundle and said multiple fibers of the other fiber bundle interlaced in said superposed fiber bundle portion and that are located at intervals in the width direction of said fiber bundles, so that said fiber bundles are joined together in said superposed fiber bundle portion.

For the production method for the fiber bundle having the fiber joint portion according to an embodiment of the invention, it is preferable that both of said first fiber bundle and said second fiber bundle are precursor fiber bundles designed for carbon fiber production.

For the production method for the fiber bundle having the fiber joint portion according to an embodiment of the invention, it is preferable that the heat conductivity of said joint fiber bundle is 3 to 700 W/m·K.

For the production method for f the fiber bundle having the fiber joint portion according to an embodiment of the invention, it is preferable that said joint fiber bundle is a carbon fiber bundle having a drape value of 2 to 15 cm and a flatness of 20 or more.

For the production method for the fiber bundle having the fiber joint portion, it is preferable that the fineness of said joint fiber bundle is 0.2 to 3.0 times that of said first fiber bundle and that of said second fiber bundle.

For the production method for the fiber bundle having the fiber joint portion, it is preferable that the tensile strength of said fiber joint portion is 20 g/tex or more at room temperature.

For the production method for the fiber bundle having the fiber joint portion, it is preferable that the distance between said first straight line and said second straight line is 20 to 100 mm, and that the distance between the fluid jetting holes in said first fluid jetting hole series and said second fluid jetting hole series is 1.7 to 4.5 mm.

A carbon fiber production method according to an embodiment of the invention is described below.

It is a carbon fiber production method in which a fiber-joint-portion-containing fiber bundle is passed continuously through an oxidizing furnace and subsequently a carbonizing furnace to produce carbon fiber.

When subjected to continuous calcination in a calcination step, the fiber-joint-portion-containing fiber bundle according to an embodiment of the invention does not suffer breakage of fiber bundles or slippage of fibers of the fiber bundles out of the fiber bundles during the calcination step, serving to prevent heat accumulation in the fiber joint portion and efficiently achieve heat removal from the fiber joint portion.

Consequently, the fiber-joint-portion-containing fiber bundle according to an embodiment of the invention can be passed continuously through the calcination step at a temperature that is not significantly lower than the furnace temperatures of calcination steps commonly used for fiber bundles free from a fiber joint portion or for a portion other than the fiber joint portion of a fiber-joint-portion-containing fiber bundle, allowing calcined fibers, such as carbon fiber, to be produced continuously through prolonged implementation of a calcination step with high operating efficiency. As a result, the productivity for calcined fibers, such as carbon fiber, can be improved largely.

DETAILED DESCRIPTION OF EMBODIMENTS OF THE INVENTION

Figure 1:
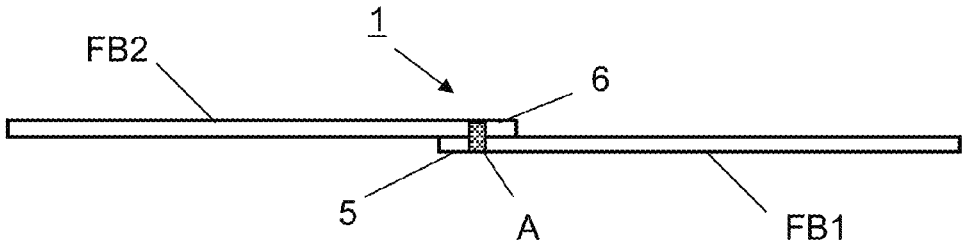
FIG. 1 shows a schematic longitudinal section of an embodiment of the fiber-joint-portion-containing fiber bundle according to the invention.

First, an embodiment of the carbon fiber production method of the invention is described. Polyacrylonitrile-based fiber bundles, pitch fiber bundles, cellulose-based fiber bundles are generally used as precursor fiber bundles for carbon fiber production. Of these, polyacrylonitrile-based fiber bundles are used widely because they can develop a high strength.

The fiber bundle passing speed at which polyacrylonitrile-based precursor fiber bundles to be used as raw yarn material for carbon fiber production passes through the production process is largely different from that for the calcination step in which the resulting precursor fiber bundles are calcined to produce carbon fiber. Accordingly, the precursor fiber bundles produced in the precursor fiber bundle production process cannot be fed continuously to the calcination step, and therefore, they are temporarily stored in an appropriate state for storage. Such appropriate states for storage include a roll wound up on a bobbin, or folded in a box. The precursor fiber bundles temporarily stored will be later pulled out from the storage facility and fed to the calcination step.

In the description given below, the precursor fiber bundle that is being pulled out of a storage facility (bobbin) and fed to the calcination step is referred to as the first fiber bundle, and the precursor fiber bundle that is subsequently to be pulled out of another storage facility (another bobbin) and fed to the calcination step is referred to as the second fiber bundle.

The first fiber bundle is first pulled out of its storage and then subjected to an oxidizing treatment in an oxidizing furnace in the calcination step. During this oxidizing treatment, the first fiber bundle is subjected to heat treatment in an oxidizing atmosphere commonly in the temperature range of 180 to 400° C. to provide an oxidized yarn. The oxidized yarn is carbonized in a carbonizing furnace installed next to the oxidizing furnace in the calcination step to provide a carbon fiber. The carbon fiber pulled out of the carbonizing furnace is then subjected to surface treatment such as with a sizing agent as required in a surface treatment step, and wound up in a winding up step to provide a carbon fiber product.

When the first fiber bundle being pulled out of its storage facility comes to the tail end portion, the tail end portion of the first fiber bundle is joined with the front end portion of the second fiber bundle pulled out of another storage facility to form an integrated yarn. Specifically, the two precursor fiber bundles are combined at the end portions, and the second fiber bundle thus joined is introduced to the calcination step as the first fiber bundle is moved forward to allow carbon fiber to be produced continuously.

The fiber-joint-portion-containing fiber bundle according to the invention aims to prevent breakage of the yarn due to heat accumulation in the fiber joint portion during the oxidizing step and rupture of the fiber bundle during the production process. The fiber joint portion may be in the form of either of the two embodiments described below.

FIG. 1 shows a fiber-joint-portion-containing fiber bundle according to a first embodiment of the fiber joint portion. In FIG. 1, a fiber bundle 1 having a fiber joint portion has a fiber joint portion A formed by superposing an end portion (tail end portion) 5 of a first fiber bundle FB1 and an end portion (front end portion) 6 of a second fiber bundle FB2 in the length direction. In a superposed fiber bundle portion where the first fiber bundle FB1 and the second fiber bundle FB2 are superposed, two or more fiber joint portions A may be formed, as required, with a distance in the length direction.

Figure 2:
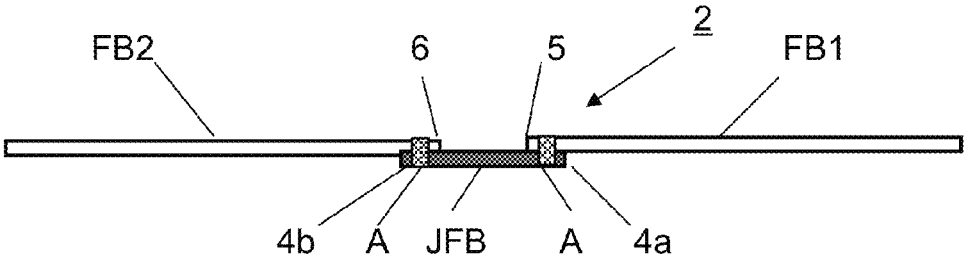
FIG. 2 shows a schematic longitudinal section of another embodiment of the fiber-joint-portion-containing fiber bundle according to the invention.

FIG. 2 shows a fiber-joint-portion-containing fiber bundle according to a second embodiment of the fiber joint portion. In FIG. 2, a fiber bundle 2 having a fiber joint portion comprises a first fiber bundle FB1, a second fiber bundle FB2, and a joint fiber bundle JFB. The fiber bundle 2 having fiber joint portion has a fiber joint portion A where an end portion (tail end portion) 5 of the first fiber bundle FB1 and an end portion 4*a* of the joint fiber bundle JFB are superposed in the length direction and also has another fiber joint portion A where an end portion (front end portion) 6 of the second fiber bundle FB2 and the other end portion 4*b* of the joint fiber bundle JFB are superposed in the length direction.

Figure 3:
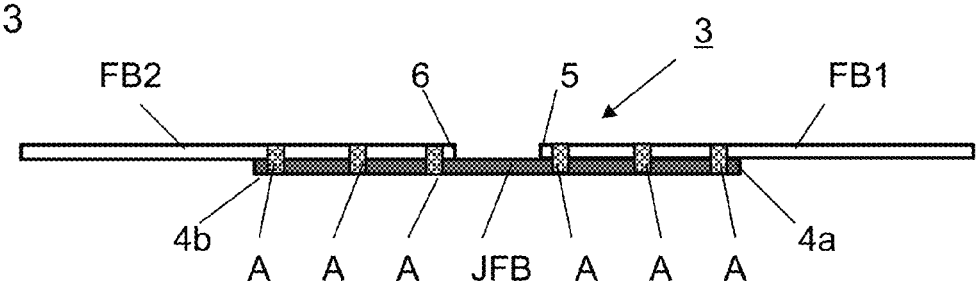
FIG. 3 shows a schematic longitudinal section of still another embodiment of the fiber-joint-portion-containing fiber bundle according to the invention.

FIG. 3 shows a modification of the fiber bundle 2 having fiber joint portion according to the second embodiment of the fiber joint portion given in FIG. 2. In FIG. 3, a fiber bundle 3 having fiber joint portion comprises a first fiber bundle FB1, a second fiber bundle FB2, and a joint fiber bundle JFB as in the case of the fiber bundle 2 given in FIG. 2. The fiber bundle 3 having fiber joint portion shown in FIG. 3 differs from the fiber bundle 2 given in FIG. 2 in that the superposed fiber bundle portion where the first fiber bundle FB1 and the joint fiber bundle JFB are superposed contains three fiber joint portions A located at intervals in the length direction and that the superposed fiber bundle portion where the second fiber bundle FB2 and the joint fiber bundle JFB are superposed contains three fiber joint portions A located at intervals in the length direction. The number of the fiber joint portions A contained in the superposed fiber bundle portion may be decided on appropriately as required.

Here, the superposed configuration of the first fiber bundle and the second fiber bundle and the superposed configuration of the first fiber bundle and the joint fiber bundle as well as the second fiber bundle and the joint fiber bundle that are described above are already known.

Described below is the structure of the fiber joint portion in the fiber-joint-portion-containing fiber bundle according to an embodiment of the invention. The fiber-joint-portion-containing fiber bundle according to an embodiment of the invention is characterized by this structure of the fiber joint portion.

Figure 4:
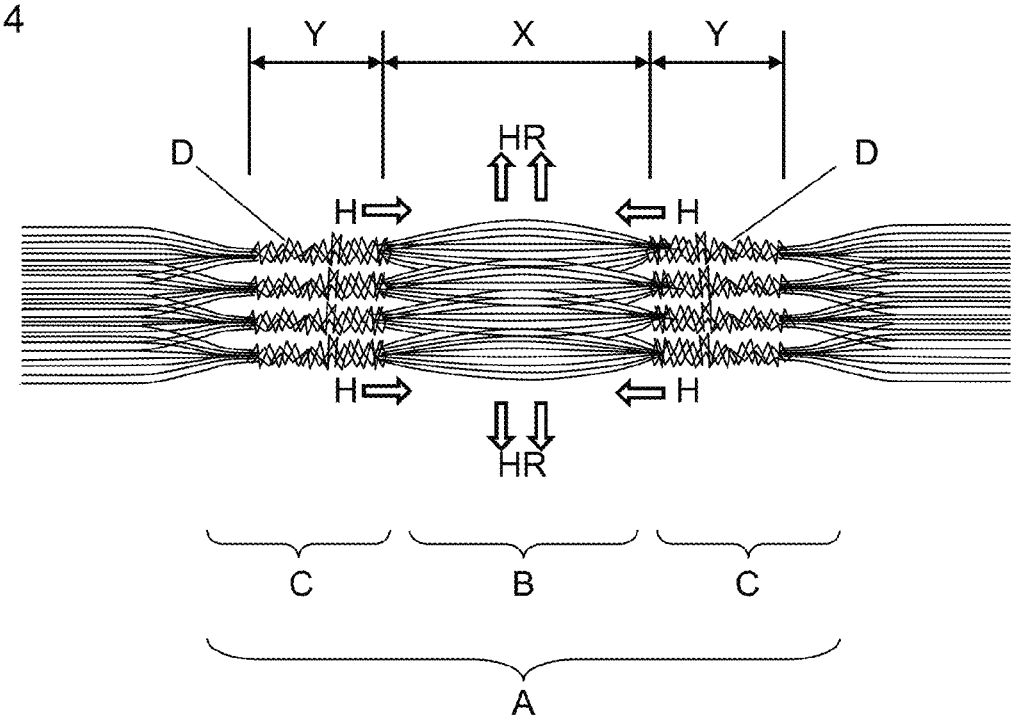
FIG. 4 shows a schematic plan view of a fiber joint portion in an embodiment of the fiber-joint-portion-containing fiber bundle according to the invention.

FIG. 4 shows a schematic plan view of an example the fiber joint portion A in the fiber-joint-portion-containing fiber bundle according to an embodiment of the invention. In FIG. 4, a fiber joint portion A has two interlaced fiber portions (tangled portions) C that contains tangles of fibers forming fiber bundles located at intervals in the length direction of the superposed fiber bundles and an unraveled fiber portion B where the fibers located between the two interlaced fiber portions C are unraveled. In addition, each of the interlaced fiber portions C is composed of two or more interlaced sub-portions D formed of tangles of multiple fibers of one fiber bundle and multiple fibers of the other fiber bundle in the superposed fiber bundle portion and located at intervals in the width direction of the fiber bundles. The superposed fiber bundles are joined by means of the two interlaced fiber portions C in the superposed fiber bundle portion to form a continuous fiber bundle having the fiber joint portion A.

As shown in FIG. 4, the fiber joint portion A where end portions of the two fiber bundles are superposed contains the unraveled fiber portion B where the multiple fibers in the two fiber bundles are unraveled. Consequently, when the fiber bundle containing this fiber joint portion A is subjected to heat treatment after being supplied to an oxidizing step, the unraveled fiber portion B functions as a heat radiator to release heat from the fiber bundle, thus preventing or relaxing the heat accumulation in the fiber joint portion A in the oxidizing step.

In the unraveled fiber portion (heat radiator portion) B, a jet of a pressurized fluid (compressed air) coming from a fiber interlacing apparatus described later directly hits the fiber bundle, and the multiple fibers in the fiber bundle are unraveled down to a single filament level. Thus, the fibers coexist without being interlaced in this portion. In the unraveled fiber portion B, it is preferable that the filaments do not adhere to each other and that they are in contact with external air. In FIG. 4, the directions of heat radiation from the unraveled fiber portion B are schematically indicated by arrows HR.

In FIG. 4, if the length X of the unraveled fiber portion B in the length direction of the fiber bundle is too short, the heat radiation effect will be small, while if it is too long, the required overall size of the fiber bundle joining apparatus will increase. Thus, it is preferable that the length X of the unraveled fiber portion B is 30 to 100 mm, more preferably 35 to 50 mm. It is also preferable that the length (width) of the unraveled fiber portion B in the width direction of the fiber bundle is 1.5 to 2 times the length (width) in the width direction of the fiber bundle before being unraveled.

The fibers will not be unraveled sufficiently, leading to insufficient heat radiation effect, if the length of the unraveled fiber portion B in the width direction of the fiber bundle is less than 1.5 times the length in the width direction of the fiber bundle before being unraveled. If the length of the unraveled fiber portion B in the width direction of the fiber bundle is more than 2 times the length in the width direction of the fiber bundle before being unraveled, the size of the unraveled fiber portion B will be too large, and it can come into contact with fibers of the neighboring fiber bundle traveling in the production process, resulting in intermingling of fibers between these bundles.

The existence of the unraveled fiber portion B in this way works to release heat accumulated in the interlaced fiber portions C located on both sides. As a result, the quantity of the heat accumulated in the fiber joint portion A can be reduced, leading to a large decrease in the breakage of the yarn due to heat accumulation.

In the interlaced fiber portion (tangled portion) C, there exist two or more, preferably 4 to 10, tangled sub-portions D in the width direction of the fiber bundle. In a tangled sub-portion D, the multiple fibers in the two superposed fiber bundles are interlaced and tangled at the single filament level. In FIG. 4, the tangled sub-portions D shown are in the form of eight braid-like regions formed of interlaced fibers and extended from the end portions of the unraveled fiber portion B in the length direction of the fiber bundle.

In FIG. 4, if the length Y of the interlaced fiber portion C in the length direction of the fiber bundle is too short, the binding strength among the fibers will be small, while if it is too long, the required overall size of the fiber bundle joining apparatus will increase. Thus, it is preferable that the length Y of the interlaced fiber portion C in the length direction of the fiber bundle is 8 to 30 mm, more preferably 10 to 18 mm.

If the interlaced fiber portion C is thus composed of two or more interlaced sub-portions D located at intervals in the width direction of the fiber bundles, the fiber bundles in the interlaced fiber portion C can be in the divided state while maintaining the connection between two adjacent fiber bundles. If there exist four or more interlaced sub-portions D, the number of filaments contained in each interlaced sub-portion D can be one fourth or less of the total number of filaments contained in each fiber bundle. In the case, for instance, where a first fiber bundle containing 12,000 filaments and a second fiber bundle containing 12,000 filaments are joined, each interlaced sub-portion D will contain about 6,000 filaments.

Thus, it becomes possible to prevent the fiber density from increasing in each interlaced sub-portion D, serving to depress the heat accumulation in the fiber joint portions A. If there are 11 or more interlaced sub-portions D, the number of filaments contained in each interlaced sub-portion D will decrease, and consequently the fiber binding strength given by each interlaced sub-portion D will decrease down to a level below the tension required for the process, making breakage of fiber bundles more likely to take place. The fibers are interlaced nearly uniformly in each interlaced sub-portion D, and therefore, the interlaced fibers can develop a sufficient joining strength for the fiber joint portions A.

The heat generated in the interlaced sub-portions D, on the other hand, move along the fibers toward the unraveled fiber portion B. In FIG. 4, this heat movement is schematically indicated by arrows H.

Figure 5:
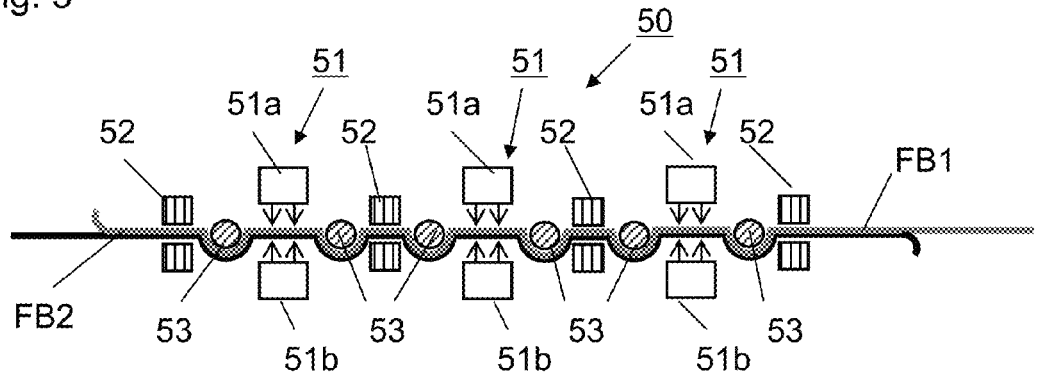
FIG. 5 shows a schematic side view of a typical fiber bundle joining apparatus used to produce the fiber-joint-portion-containing fiber bundle according to an embodiment of the invention.

FIG. 5 shows a schematic side view of an example of the fiber bundle joining apparatus used to carry out a production method for the fiber-joint-portion-containing fiber bundles according to the invention. In FIG. 5, a fiber bundle joining apparatus 50 comprises four fiber bundle clamping devices 52 located at intervals in the length direction of the apparatus, three fiber interlacing devices 51 located between the fiber bundle clamping devices 52, and six fiber bundle relaxing devices 53 located between the fiber bundle clamping devices 52 and the fiber interlacing devices 51*a*. Each fiber interlacing device 51 is composed of an upper fiber interlacing device 51*a* and a lower fiber interlacing device 51*b* located opposite to each other in the vertical direction with a space between them.

Under the upper fiber interlacing devices 51*a* and above the lower fiber interlacing devices 51*b*, two parallel series of several fluid jetting holes aligned in the width direction of the first fiber bundle FB1 and the second fiber bundle FB2 passing through the fiber bundle joining apparatus 50 are provided with a distance in the length direction of the fiber bundles.

Each fiber bundle clamping device 52 has an upper clamping plate and a lower clamping plate that open in the vertical direction to sandwich the first fiber bundle FB1 and the second fiber bundle FB2.

The fiber bundle relaxing devices 53 are used to relax the superposed first fiber bundle FB1 and second fiber bundle FB2 by a certain distance in the length direction. When the fiber bundle clamping devices 52 is not working to clamp the fiber bundles, rollers that can move in the vertical direction and extends in the width direction of the fiber bundles, for instance, press down the fiber bundles to relax the fiber bundles by a certain distance in the length direction. After such relaxation of the fiber bundles is achieved, the fiber bundle clamping devices 52 are actuated to clamp the fiber bundles. This relaxed state of the fiber bundles is preferable because the multiple fibers in the fiber bundles can be interlaced easily by the fiber interlacing devices 51, and it is also useful to adjust the degree of the interlacing of fibers.

Described below is the use of this fiber bundle joining apparatus 50 to join the first fiber bundle FB1 and the second fiber bundle FB2.

First, the tail end portion of the first fiber bundle FB1 passing through a calcination step and the front end portion of the second fiber bundle FB2 to be fed to the calcination step are superposed and positioned in the fiber interlacing devices 51. It is preferable that the length of the superposed end portions is 350 to 500 mm in the length direction of the fiber bundles. It is also preferable that the fiber bundles FB1 and FB2 are superposed in a flat state with a thickness of 0.1 to 1.0 mm. This allows the multiple fibers in the fiber bundles FB1 and FB2 to be unraveled to the single filament level and intermingled sufficiently in the superposed fiber bundle portion when receiving pressurized fluid jets in the fiber interlacing devices 50.

Then, the fiber bundle relaxing devices 53 located adjacent to the fiber interlacing devices 51 work to form relaxed portions in the superposed fiber bundles in the neighborhood of the fiber interlacing devices 51. Specifically, a weight or the like may be applied to press down both the fiber bundles FB1 and FB2 to relax them. The degree of relaxation is preferably 5 to 25%. If the degree of relaxation is less than 5%, the fibers will not be interlaced strongly enough and the binding strength in the fiber joint portion will decrease, whereas if the degree of relaxation is more than 25%, the size of the interlaced fiber portion will increase and the yarn will become more likely to be broken by accumulated heat.

Subsequently, the two fiber bundles are gripped between the upper clamping plate and the lower clamp plate in the fiber bundle clamping devices 52 to fix the two superposed fiber bundles FB1 and FB2. Then, the weight used to relax the fiber bundles FB1 and FB2 is removed and pressurized fluid jets are applied from the upper fiber interlacing devices 51*a* and the lower fiber interlacing devices 51*b* of the fiber interlacing devices 51. This application of pressurized fluid jets acts to interlace the multiple fibers in the fiber bundles FB1 and FB2 between the fiber bundle clamping devices 52 to form the fiber joint portions and remove the relaxation in the fiber bundles FB1 and FB2. The fluid used may be liquid or gas that can be supplied in a compressed state. Commonly, air is used as the fluid in view of the workability and economic efficiency.

Figure 6:
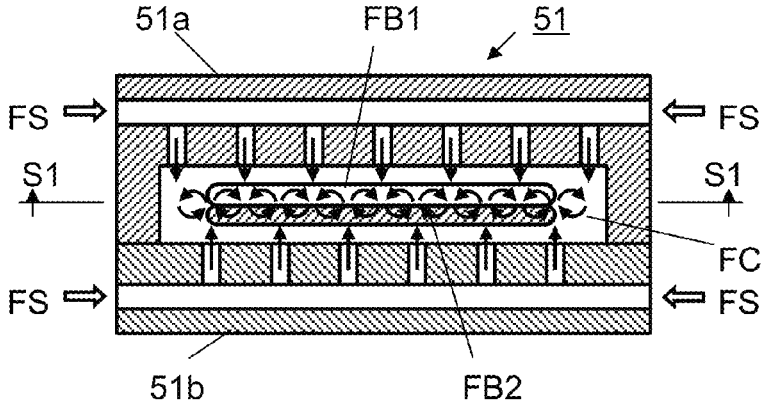
FIG. 6 shows a schematic cross section of a typical fiber interlacing apparatus designed to interlace fibers to be used to carry out the method to produce the fiber-joint-portion-containing fiber bundle according to an embodiment of the invention.
Figure 7:
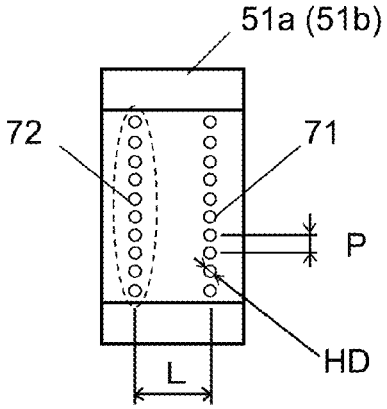
FIG. 7 shows an S1-S1 cross section of the fiber interlacing apparatus indicated by arrows in FIG. 6.
Figure 8:
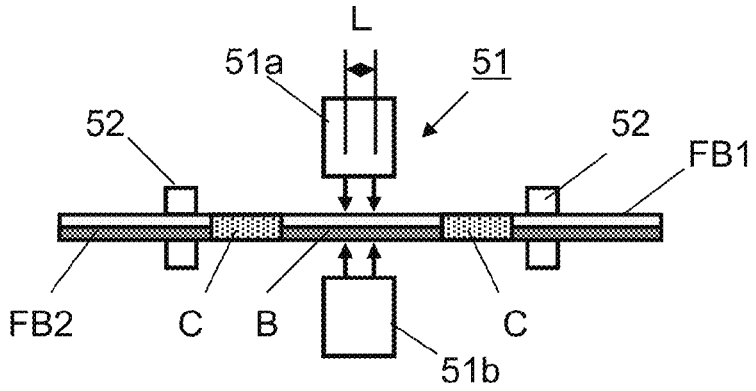
FIG. 8 shows a schematic side view illustrating a state of a fiber joint portion in an embodiment of the fiber-joint-portion-containing fiber bundle according to the invention that is being produced in the fiber interlacing apparatus shown in FIG. 6.

How the fiber joint portions A are formed is described below with reference to, FIGS. 6, 7, and 8. FIG. 6 shows a schematic cross section of an example of the fiber interlacing devices 51. FIG. 7 shows a S1-S1 cross section of the fiber interlacing devices 51 indicated by the arrows in FIG. 6. FIG. 8 shows a schematic side view illustrating how a fiber joint portion is formed by the fiber interlacing device given in FIG. 6.

A fiber interlacing device 51 comprises an upper fiber interlacing device 51*a* and a lower fiber interlacing device 51*b*. The upper fiber interlacing device 51*a* and the lower fiber interlacing device 51*b* each has a first fluid jetting hole series 71 containing a plurality of fluid jetting holes aligned at intervals along a first line perpendicular to the length direction of the fiber bundles and a second fluid jetting hole series 72 containing a plurality of fluid jetting holes aligned at intervals along a second line that is parallel to the first line and located at a distance away from the first line in the length direction of the fiber bundles.

The fluid jetting holes of the first fluid jetting hole series 71 and the second fluid jetting hole series 72 of the upper fiber interlacing device 51*a* are open on the lower face of the upper fiber interlacing device 51*a*. The fluid jetting holes of the first fluid jetting hole series 71 and the second fluid jetting hole series 72 of the lower fiber interlacing device 51*b* are open on the upper face of the lower fiber interlacing device 51*a*. Fluid chambers FC are provided between the lower face of the upper fiber interlacing device 51*a* and the upper face of the lower fiber interlacing device 51*a*.

A pressurized fluid supply path FS is provided on the upstream side of the fluid jetting holes of the first fluid jetting hole series 71 and the second fluid jetting hole series 72 of the upper fiber interlacing device 51*a*. Another pressurized fluid supply path FS is provided on the upstream side of the fluid jetting holes of the first fluid jetting hole series 71 and the second fluid jetting hole series 72 of the lower fiber interlacing device 51*b*.

The pressurized fluid (compressed air) emitted from the fluid jetting holes forms thin pressurized fluid jets having a large linear speed, and the fluid jetting holes are located so that two or more uniform fluid vortexes are produced in the pressurized fluid chambers FC. The pressurized fluid jets can work to finely unravel the multiple fibers in the fiber bundles FB1 and FB2 to the single filament level. This unraveling of fibers causes the formation of the unraveled fiber portion B.

The interlacing of the unraveled multiple fibers begins at the fiber bundle clamping device 52 that fixes the fiber bundles and acts as starting point, and subsequently proceeds toward the fiber interlacing device 51. By the two or more uniform fluid vortexes formed in the pressurized fluid chambers FC, the multiple fibers in the two fiber bundles FB1 and FB2 are divided into smaller bundles to form two or more interlaced sub-portions D. As the thin pressurized fluid (compressed air) jets having a large linear speed are uniform in the width direction of the fiber bundles, the bundles can be divided into sub-bundles containing roughly the same number of filaments, resulting in the formation of two or more interlaced sub-portions D that are uniform in the width direction of the fiber bundles. Thus, an interlaced fiber portion C containing two or more interlaced sub-portions D having little variation in binding strength is formed.

To form an unraveled fiber portion B that functions as a heat radiator portion to release heat outside, it is necessary for the fiber interlacing device 51 to have two parallel series of fluid jetting holes located away from each other in the length direction of the fiber bundles. There is no starting point necessary for the interlacing of fibers between the two series of jetting holes, and therefore, the fibers are not interlaced between the two series of jetting holes, and the multiple fibers are left unraveled. Thus, interlacing of fibers does not take place between the two series of jetting holes. As a result, as shown in FIG. 8, the unraveled fiber portion (heat radiator portion) B is formed between the two series of jetting holes, and the interlaced fiber portion C is formed between the fiber interlacing device 51 and the fiber bundle clamping device 52.

Thus, to produce fiber joint portions that contain both the unraveled fiber portion (heat radiator portion) B and the interlaced fiber portion C, it is necessary for the fiber interlacing device 51 to have two parallel series of fluid jetting holes 71 and 72 located away from each other intervals in the length direction of the fiber bundles. The multiple fibers in the fiber bundles cannot be left unraveled if only one series of fluid jetting holes is provided on the lower face of the upper fiber interlacing device 51*a* and on the upper face of the lower fiber interlacing device 51*b*.

In such a case, fibers will be interlaced to the center of the fiber bundle located between two adjacent fiber bundle clamping devices 52, failing to produce an unraveled fiber portion (heat radiator portion) that can release heat to outside. Despite only one series of fluid jetting holes, it is possible to form an apparently unraveled fiber portion (heat radiator portion) if the interlacing time is shortened. In this case, however, due to the short interlacing time, it will be impossible to form an interlaced fiber portion having a sufficiently high binding strength, and the fiber bundles will be easily broken when passing through the process. If there are three or more series of fluid jetting holes, not only the compressed air supply rate will increase, but also the fiber bundles in the unraveled fiber portion (heat radiator portion) will be damaged by the pressurized fluid (compressed air), making the rupture of the fiber bundles more likely to take place when passing through the process.

The length L (spacing) between the two series of fluid jetting holes 71 and 72 measured in the length direction of the fiber bundles is preferably 20 to 100 mm, more preferably 25 mm to 55 mm. The size of the unraveled fiber portion (heat radiator portion) will be small, making it difficult to produce an unraveled fiber portion (heat radiator portion) having a sufficient heat radiation capability, if the length L is less than 20 mm, while the size of the unraveled fiber portion (heat radiator portion) will become larger than necessary if the length L is more than 100 mm.

An arranging pitch P of the fluid jetting holes in the series of fluid jetting holes is preferably 1.7 to 4.5 mm, and the diameter HD of the fluid jetting holes is preferably 1.2 to 2.5 mm. In view of the accuracy for processing of the fluid jetting holes, a certain thickness of material is necessary between the jetting holes, and therefore, the arranging pitch P of the fluid jetting holes is preferably 0.5 mm or more larger than the diameter HD of the fluid jetting holes.

If the arranging pitch P of the fluid jetting holes is less than 1.7 mm, it will be impossible to produce thin compressed air jets having a large linear speed, but the jets will be in a planar form, which will fail to unraveled the fiber bundles to the single filament level and produce an interlaced fiber portion.

If the arranging pitch P of the fluid jetting holes is more than 4.5 mm, the size of the interlaced sub-portions will increase and each interlaced sub-portion will contain a larger number of filaments, possibly failing to control the heat accumulation.

With respect to the diameter HD of the fluid jetting holes as well, it will be impossible to produce thin pressurized fluid (compressed air) jets having a large linear speed, unravel the fiber bundles, and produce an interlaced fiber portion if the diameter HD of the fluid jetting holes is small. If the diameter HD of the fluid jetting holes is large, the diameter of the pressurized fluid (compressed air) jets emitted from the fluid jetting holes will increase, it will be impossible to unravel the fiber bundles to the single filament level, possibly leading to insufficient unraveling and failing to achieve a sufficient heat radiation capability.

It is preferable that the pressure for the pressurized fluid (compressed air) jets is 0.3 to 0.6 MPa. If the pressure is less than 0.3 MPa, the multiple fibers in the fiber bundles will not be unraveled sufficiently, possibly making it difficult to produce an interlaced fiber portion having two or more interlaced sub-portions. If the pressure is more than 0.6 MPa, the fiber bundle will be damaged by the pressurized fluid, possibly leading to breakage of the fiber bundles.

It is possible to divide the two fiber bundles into two or more smaller fiber bundles separated apart in the width direction and processing them by a plurality of fiber interlacing devices, followed by combining them into one fiber joint portion. However, not only the workability will deteriorate, but also the fiber bundles will be fuzzed when divided, leading to a decrease in the joining strength. It is preferable, therefore, that the entire fiber bundles are subjected to a fiber interlacing step in one fiber interlacing device without dividing them into two or more fiber bundles apart in the width direction.

It is preferable that both the first fiber bundle FB1 and the second fiber bundle FB2 are precursor fiber bundles designed for carbon fiber production.

FIGS. 2 and 3 show schematic longitudinal sections of an example of the fiber-joint-portion-containing fiber bundle in which the precursor fiber bundles are joined via a joint fiber bundle (connection medium).

For the embodiment using a joint fiber bundle (connection medium), it is preferable that the joint fiber bundle has a heat conductivity of 3 to 700 W/m·K. For the embodiment using this joint fiber bundle (connection medium), it is preferable that the joint fiber bundle has a calorific value of 500 cal/g or less in an atmosphere temperature of 150 to 400° C. and at the same time has a heat conductivity of 3 to 700 W/m·K. In addition to these preferable conditions, it is preferable that the joint fiber bundle composed of multiple fibers contains 3,000 or more filaments (the number of filaments) and the joint fiber bundle also has a drape value of 2 to 15 cm and a flatness of 20 or more.

For instance, when this joint fiber bundle is used, the tail end portion 5 of the first fiber bundle FB1 and an end portion of the joint fiber bundle JFB are superposed, and in addition, the front end portion 6 of the second fiber bundle FB2 and the other end portion of the joint fiber bundle JFB are superposed, followed by placing the superposed portion in the fiber interlacing device 51. It is preferable that each end portion and the joint fiber bundle are superposed over a length of 350 to 500 mm in the length direction of the fiber bundles.

If the joint fiber bundle used is non-exothermic (with a calorific value of 500 cal/g or less) and in addition, has a heat conductivity of 3 to 700 W/m·K, it is possible to largely reduce the heat generation from the fiber joint portion A during the oxidizing treatment and at the same time, accelerate the removal of heat in the interlaced fiber portion of the first fiber bundle FB1 and the second fiber bundle FB2 that is accumulated during the oxidizing treatment, leading to a large reduction in the breakage of the yarn due to heat accumulation. The joint fiber bundle is preferably a carbon fiber bundle.

It is preferable that the multiple fibers in the fiber joint portion A contain 3,000 to 100,000 filaments (the number of filaments). It is more preferably 12,000 to 60,000. The filaments preferably have a fineness of 0.8 to 1.7 dtex (0.7 to 1.5 deniers).

This fiber joint portion A works very effectively for joining of polyacrylonitrile-based precursor fiber bundles. Thus, polyacrylonitrile-based precursor fiber bundles having this fiber joint portion do not suffer breakage caused by heat accumulation when passing through the calcination step and do not require reduction in temperature of the oxidizing furnace, serving effectively for continuous production of carbon fiber.

In the fiber bundle having the fiber joint portion A shown in FIGS. 2 and 3, the first precursor fiber bundle (the first fiber bundle) FB1 and the second precursor fiber bundle (the second fiber bundle) FB2 are joined via a third fiber bundle (joint fiber bundle) JFB that bridges them. A carbon fiber bundle that has a heat conductivity of 3 to 700 W/m·K, comprises 3,000 or more filaments, and also has a drape value of 2 to 15 cm and a flatness of 20 or more is preferably used as this joint fiber bundle JFB.

In the joint portion of precursor fiber bundle and a carbon fiber bundle, the multiple fibers in the first precursor fiber bundle FB1 and those in the carbon fiber bundle JFB are tangled to form a fiber joint portion A. In addition, the multiple fibers in the carbon fiber bundle JFB and those in the second precursor fiber bundle FB2 are tangled to form another fiber joint portion A.

The fiber-joint-portion-containing fiber bundle shown in FIG. 2 has two fiber joint portions A, i.e. one in the superposed portion of the first precursor fiber bundle FB1 and the carbon fiber bundle JFB and the other in the superposed portion of the carbon fiber bundle JFB and the second precursor fiber bundle FB2. The total tensile strength of the joint portions increases with an increasing number of the fiber joint portions, but a larger size apparatus will be required, leading to an increase in equipment cost, if several fiber joint portions are to be produced simultaneously. Or, fiber bundles may be passed several times through an apparatus designed for production of one fiber joint portion, but this will lead to an undesirable increase in operation procedures. The number of fiber joint portions is preferably two or, as shown in FIG. 3, three or four.

The end portions 4*a*, 4*b* of the joint fiber bundle FJB, the end portion 5 of the first precursor fiber bundle FB1, and the end portion 6 of the second precursor fiber bundle are preferably cut so that they are located about 1 to 5 cm from the end portions of the fiber joint portions A. The precursor fiber bundles can suffer shrinkage when undergoing heat treatment in the oxidizing furnace. To prevent the interlaced fiber portion from being undone, the position of each end portion is preferably adjusted, leaving an about 1 cm tip unprocessed. If it is longer than 5 cm, troubles such as intermingling of fibers into the neighboring fiber bundle may take place during the calcination step.

It is preferable that the joint fiber bundle is a carbon fiber bundle that has a heat conductivity of 3 to 700 W/m·K or less, comprises 3,000 or more filaments, and also has a drape value of 2 to 15 cm and a fiber bundle flatness, which is described later, of 20 or more.

The number of filaments in the joint fiber bundle may be changed appropriately to meet the number of filaments in the precursor fiber bundle to be interlaced by interlacement. If the number of filaments is less than 3,000, however, the joint fiber bundle and the precursor fiber bundle will not be interlaced sufficiently, possibly leading to breakage of the fiber bundles due to the tension caused during the calcination step. An increase in the number of filaments can serve for efficient removal of the reaction heat generated from the precursor fibers in the oxidizing furnace. If the number of filaments is increased excessively and the fiber bundles become too thick, however, the interlaced fiber portion of the joint fiber bundle and the precursor fiber bundle will also become too thick, possibly leading to troubles such as the intermingling of fibers into the neighboring fiber bundle during the traveling through the calcination step. Thus, the number of filaments is preferably 100,000 or less.

If the carbon fiber bundle used as joint fiber bundle has a heat conductivity of less than 3 W/m·K, the heat generated in the fiber joint portions during the oxidizing treatment will not be released sufficiently, that is, a sufficient heat removal capability will not be developed, leading to breakage of the fiber bundles due to heat accumulation. If the heat conductivity of the carbon fiber bundle is more than 700 W/m·K, the elastic modulus of the fiber bundle will be too high and a joined portion will not be formed appropriately, thus canceling the high heat removal capability. The heat conductivity of the carbon fiber bundle is more preferably 7 to 50 W/m·K.

The heat conductivity is calculated by the following equation 1 based on the thermal diffusion, density, and specific heat of the fiber bundle.

$$\lambda=\alpha\rho Cp \quad \text{(Equation 1)}$$

λ: heat conductivity (W/(m·k))

α: thermal diffusion ($m^2/s$)

The thermal diffusion is calculated according to the light/alternating current method described in the following document: T. Yamane, S. Katayama, M. Todoki and I. Hatta, J. Appl. Phys., 80 (1996) 4385.

ρ: density ($kg/m^3$)

The density is calculated by the following equation 2 based on the weight $W_1$ (kg) of the specimen in air, and the weight $W_2$ (kg) of the specimen immersed in a liquid having a density of $\rho_L$.

$$\rho=W_1\times\mu L(W_1-W_2) \quad \text{(Equation 2)}$$

Cp: specific heat (J/(kg·K))

The specific heat is determined by DSC (differential scanning calorimetry) at a measuring temperature of 25° C. according to JIS-R1672. The DSC equipment used should be functionally equivalent to Perkin-Elmer DSC-7. Sapphire ($\alpha$-$Al_2O_3$) and aluminum containers may be used as standard materials.

The average of two measurements was taken for the heat diffusion and specific heat of the fiber bundle samples, and the average of six measurements was taken for the density.

If the drape value of the joint fiber bundle is more than 15 cm, the fiber bundle will be too stiff, and the multiple fibers in the joint fiber bundle will not spread appropriately during the fiber interlacement step using a pressurized fluid, failing to achieve uniform fiber interlacement between the multiple fibers in the first precursor fiber bundle and the multiple fibers in the joint fiber bundle and between the multiple fibers in the second precursor fiber bundle and the multiple fibers in the joint fiber bundle. Thus, the drape value of the joint fiber bundle is preferably 10 cm or less, more preferably 8 cm or less.

The drape value represents the stiffness of the fiber bundle. A fiber bundle having a smaller drape value is regarded as softer and small in ability to maintain its shape. The lower limit of the drape value of the joint fiber bundle is preferably 2 cm. The multiple fibers in a fiber bundle can be interlaced more easily as the fibers can spread more smoothly and the fiber bundle is generally softer. If the drape value is less than 2 cm, however, the fiber bundle will be too soft and difficult to handle. In addition, as the multiple fibers will tend to spread excessively, filaments that can work effectively for heat removal will be broken easily when joined with the precursor fiber bundle, and the tensile strength will become too small to resist the tension during the process. Thus, the drape value is preferably 2 cm or more.

Many means are available to control the drape value, but typically, it can be controlled by changing the quantity of the sizing agent added to the joint fiber bundle. The drape value increases as the quantity of the sizing agent added increases, while it decreases as the latter quantity decreases. Thus, the drape value of the joint fiber bundle can be adjusted to an appropriate value.

Figure 9:
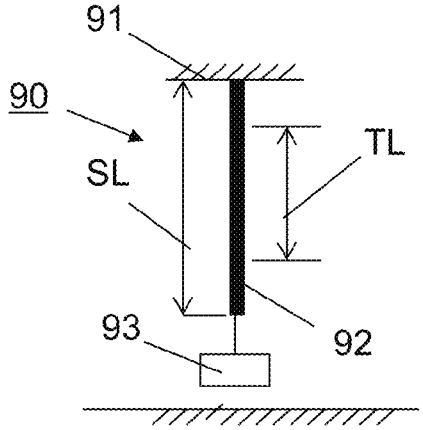
FIG. 9 shows a schematic side view of a test sample preparing apparatus to prepare test samples for measuring a drape value of a joint fiber bundle to be used in the fiber-joint-portion-containing fiber bundle according to an embodiment of the invention.

The drape value measuring method is described below with reference to FIGS. 9 to 11. First, a sample for the measurement having a length SL of about 50 cm is cut out of the joint fiber bundle (carbon fiber bundle) to prepare a sample for the measurement. FIG. 9 shows a schematic side view of a test sample preparing apparatus to prepare a test piece for measuring the drape value. In FIG. 9, the top portion of the test sample preparing apparatus 90 has a sample fixing portion 91 that holds the top end of the test sample. The top end of the test sample 92 is fixed to the sample fixing portion 91 so that the test sample 92 hangs down.

Subsequently, the weight 93 is fixed to the bottom end of the test sample 92 so that a tension of 0.0375 g/tex is applied to the test sample 92. Then, an atmosphere of a temperature of 23° C. and a humidity of 60% is maintained inside the sample preparing apparatus 90. The test sample 92 is left to stand in this atmosphere for 30 minutes or more. Then, the test sample 91 is taken out of the test sample preparing apparatus 90. The top and bottom ends of the resulting test sample 91 are removed to prepare a test piece having a length TL of 30 cm.

Figure 10:
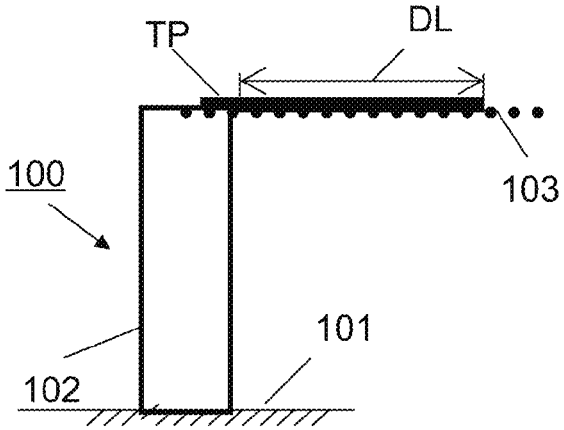
FIG. 10 shows a schematic side view of a drape value measuring apparatus to measure a drape value of a test piece cut out from the test sample prepared in FIG. 9.
Figure 11:
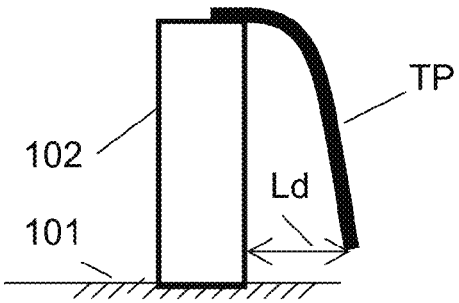
FIG. 11 shows a schematic side view illustrating the measuring method to determine the drape value of a test piece fixed on the drape value measuring apparatus shown in FIG. 10.

FIG. 10 shows a schematic side view of a drape value measuring apparatus to measure the drape value of a test piece cut out from the test sample prepared in FIG. 9. In FIG. 10, the drape value measuring apparatus 100 comprises a square pillar 102 fixed vertically on the top face of a base 101, and a flat plate 103 that is attachable to the top face of the square pillar 102 so that it extends in the perpendicular direction to the vertical side face of the square pillar 102.

In the drape value measuring apparatus 100, an end of the test piece TP prepared above is fixed to the top face of the square pillar 102, and the test piece TP is placed on the top face of the flat plate 103. Thus, the test piece TP is fixed in a cantilever-like manner so that is held parallel to the top face of the base 101 instead of hanging down. A 5 cm long end portion of the test piece TP is used for fixing to the top face of the square pillar 102, and the length DL of the portion protruding from the vertical side face of the square pillar 102 is 25 cm.

When the test piece TP has been fixed to the drape value measuring apparatus 100, the flat plate 103 is removed quickly from the square pillar 102. No longer supported by the flat plate 103, the test piece TP is pulled by gravity and hangs down as shown in FIG. 11. One second after removing the flat plate 103 to cause the test piece TP to hang down, the horizontal distance Ld (cm) between the tip (free end) of the test piece 103 and the vertical side face of the square pillar 102 is measured to provide the drape value.

For the superposed fiber bundle portion of the first precursor fiber bundle and the joint fiber bundle and the superposed fiber bundle portion of the second precursor fiber bundle and the joint fiber bundle, the flatness of the joint fiber bundle (carbon fiber bundle) is preferably 20 or more to maintain uniform interlacement among the fibers in both of the superposed fiber bundle portions. If the flatness is less than 20, the joint fiber bundle will be thin, and the multiple fibers in the joint fiber bundle will tend to be unraveled ununiformly by the fluid during the interlacement step. Furthermore, it can lead to a decrease in the tensile strength in the fiber joint portion and a decline in the yarn rupture temperature in the calcination step.

The upper limit of the flatness is about 200, and if it is more than 200, the fiber bundle will be too wide, and uneven interlacement can take place easily in the portion where the fibers in the first precursor fiber bundle and those in the joint fiber bundle are interlaced and in the portion where the fibers in the second precursor fiber bundle and those in the joint fiber bundle are interlaced, leading to a decrease in the tensile strength in the fiber joint portion during the calcination step.

The flatness of the joint fiber bundle (carbon fiber bundle) is defined as the width W of the joint fiber bundle to the thickness T of the joint fiber bundle, that is, W/T.

The width W (mm) of the joint fiber bundle is defined as the width-directional size of the joint fiber bundle placed stationarily on a flat table for measurement, and the size in the width direction is measured directly with a ruler.

The thickness T (mm) of the joint fiber bundle is calculated from the equation 3 and equation 4 based on the fineness Y(g/m) of each filament of the multiple filaments in the joint fiber bundle, their density ρ (kg/m$^3$), the number F of the filaments contained the joint fiber bundle, and the width W (mm) of the joint fiber bundle.

$$D(\text{mm})=\sqrt{(4\times Y\times 10^3/(\pi\times\rho))} \quad \text{(Equation 3)}$$

$$T(\text{mm})=F\times D^2/W \quad \text{(Equation 4)}$$

It is preferable that fineness of the joint fiber bundle is 0.2 to 3.0 times that of the first precursor fiber bundle and that of the second precursor fiber bundle. If it is less than 0.2 times, defective fiber interlacement regions where fibers in the joint fiber bundle are not interlaced will be formed in the first precursor fiber bundle portion and the second precursor fiber bundle portion. If it is more than 3.0 times, defective interlacement will tend to take place in the joint fiber bundle portion, leaving fibers that are not tangled with those in the first precursor fiber bundle and the second precursor fiber bundle fiber.

The fineness of the joint fiber bundle is 0.3 to 1.2 times, still more preferably 0.4 to 0.8 times, that of the first precursor fiber bundle and that of the second precursor fiber bundle. Regardless of whether the fineness of the first precursor fiber bundle and that of the second are identical or different, if the fineness of the joint fiber bundle is in the above-mentioned preferable fineness range, fiber bundles having such a fiber joint portion composed of them can pass the calcination step smoothly, and it will be possible to calcine these fiber bundles continuously. Thus, continuous production of carbon fiber bundles becomes possible.

It is preferable that the joint portion between a precursor fiber bundle and a carbon fiber bundle has a tensile strength of 20 g/tex or more in an atmosphere of normal temperature. Normal temperature is commonly around the temperature of the work environment for the operation of joining the precursor fiber bundle and the carbon fiber bundle, which is around the outside air temperature, specifically 20 to 30° C. It is preferable that the joint portion maintains a tensile strength of 20 g/tex or more at any temperature in this temperature range. It is more preferable that the joint portion maintains a tensile strength of 20 g/tex or more at any temperature in the temperature range from about 5° C. to 50° C.

If the tensile strength of the joint portion is less than 20 g/tex at some temperature in the above temperature range, the joint portion will not be able to resist the tension and will suffer breakage in the calcination step. The tensile strength of the joint portion should preferably be as high as possible in view of the smoothness in passing through the calcination step. However, filaments in the precursor fiber bundle, and in turn those in the carbon fiber bundle, can be broken as the tensile strength of the joint portion is increased largely to strengthen the fiber interlacement. Thus, a tensile strength of about 50 g/tex is high enough for the joint portion.

To determine the tensile strength, the end portion of the precursor fiber bundles and the end portion of the carbon fiber bundle joined together are pulled apart at a tension speed of 100 mm/min in a tensile testing machine (roughly equivalent to Orientec RTC-1225A tensile testing machine) to measure the maximum tensile strength, which is then divided by the fineness (tex) of either the first or the second precursor fiber bundle that was broken.

If the carbon fiber bundle used as joint fiber bundle meets all the requirements of having a heat conductivity of 3 to 700 W/m·K, comprising 3,000 or more filaments and having a drape value of 2 to 15 cm and a flatness of 20 or more, the fiber-joint-portion-containing fiber bundle comprising it can pass very smoothly through the calcination step.

A carbon fiber bundle having a heat conductivity of 3 to 700 W/m·K and comprising 3,000 or more filaments can be produced by appropriately controlling the number of filaments in the precursor fiber bundle and the calcination conditions that influences the degree of carbonization or graphitization.

A preferable procedure to produce a carbon fiber bundle having a drape value of 2 to 15 cm and a flatness of 20 or more that can be used as joint fiber bundle is, for instance, as described below. First, a polyacrylonitrile fiber bundle to be used as precursor fiber, which is produced by spinning polyacrylonitrile input material, is wound up on a bobbin. The polyacrylonitrile fiber bundle is pulled out from the bobbin, subjected to oxidizing treatment in air at 230° C. to 280° C., and then carbonized in a carbonizing furnace controlled at temperatures below 1,900° C. to produce a carbon fiber bundle. If necessary, the resulting carbon fiber bundle may be heated up to a temperature of 1,900° C. to 2,600° C. to produce a graphitized fiber bundle.

The resulting carbon fiber bundle or graphitized fiber bundle is treated with a sizing agent under a tension of 1.5 to 6.0 g/tex, preferably 2.0 to 5.5 g/tex, and then the fiber bundle is pressed against a hot roll controlled at a temperature of 100 to 150° C. to flatten it, followed by drying and winding up. This step produces a carbon fiber bundle having a drape value of 2 to 15 cm and a flatness of 20 or more. Here, there are no particular limitations on the sizing agent to be used, as long as its application quantity, application method and drying temperature are controlled appropriately to maintain the drape value in the above-mentioned range.

If a carbon fiber bundle having such characteristics is used as joint fiber bundle, it will be possible to efficiently remove the heat generated in the fiber bundle in the oxidizing furnace and largely improve the productivity of carbon fiber production.

The present invention is illustrated below in greater detail with reference to examples, but it should be understood that the invention is not construed as being limited thereto.

In these examples, tests were carried out to measure the passable furnace temperature at which the fiber-joint-portion-containing fiber bundle is not broken as it passes through an oxidizing furnace provided in a carbon fiber production process, and the passable process tension under which it is not broken as it passes through the production process where the oxidizing furnace temperature is adjusted to 245° C. To provide an indicator of the workability, tests were carried out to measure the step-passing rate under the conditions of an oxidizing furnace temperature of 245° C. and a feeding tension in the process of 5 kg/st.

In all examples, the fiber bundle sample was subjected to an oxidizing treatment for 60 minutes in an oxidizing t furnace. The temperature in the oxidizing furnace was controlled in 1° C. increments considering the fluctuation in temperature control. Tests were conducted for 20 samples, and the number of samples that succeeded in passing through the production process was used to determine the process-passing rate.

The precursor fiber bundle used in examples was a polyacrylonitrile-based precursor fiber bundle comprising 24,000 filaments, each having a fineness of 1.0 dtex (0.9 denier). Results in examples and comparative examples are listed in Table 1.

Example 1

An end portion 5 of a first precursor fiber bundle FB1 and an end portion 6 of a second precursor fiber bundle FB2 were superposed over a length of 400 mm as the size of a superposed fiber bundle portion. The fiber bundle joining apparatus shown in FIG. 5 was used to join the two fiber bundles by forming the superposed fiber bundle portion. Three fiber interlacing devices 51 were used to perform this. In each fiber interlacing device 51, the fluid jetting holes in the first fluid jetting hole series 71 and the second fluid jetting hole series 72 had a diameter of 1.5 mm, and the spacing between the fluid jetting holes was 2.5 mm. The distance (hole series spacing) L between the two fluid jetting hole series 71 and 72 was 30 mm as measured in the length direction of the fiber bundles. The superposed first and second fiber bundles FB1 and FB2 were relaxed by 9.0% in the fiber bundle relaxing device 53 using a round bar.

Subsequently, air jets compressed at a pressure of 0.4 MPa were applied for 2 seconds from the fluid jetting holes. This produced three fiber joint portions in the fiber bundles. Each of the resulting fiber joint portions A had an unraveled fiber portion (heat radiator portion) B and two interlaced fiber portions C. The length X of each unraveled fiber portion (heat radiator portion) B was 42 mm, and the width of the unraveled fiber portion (heat radiator portion) was 1.6 times that of the fiber bundles before unraveling. Each of the interlaced fiber portions C had four interlaced sub-portions D. Each interlaced fiber portion C had a length Y of 14 mm.

On the other hand, the same precursor fiber bundle but free of fiber joint portions, i.e. a continuous unprocessed fiber bundle, was subjected to oxidizing treatment in an oxidizing furnace.

Table 1 show results of oxidizing treatment of the continuous unprocessed fiber bundle and results of oxidizing treatment of the fiber bundle having fiber joint portions prepared in Example 1. It was seen that compared with the continuous unprocessed fiber bundle, the passable furnace temperature of the oxidizing furnace was about 10° C. lower for the continuous fiber bundle having fiber joint portions prepared in Example 1, but the temperature drop was not as large as to cause a significant reduction in the workability. The passable process tension was 7 kg/st, and the process-passing rate was 95%, both of which are not serious values. It was also confirmed that the calcined joint portions maintained a uniform, flattened joint configuration. This suggests that intermingling did not take place between fibers in the travelling adjacent fiber bundles.

Example 2

The same first precursor fiber bundle FB1 and second precursor fiber bundle FB2 as in Example 1 were prepared. Elsewhere, a joint fiber bundle JFB was prepared from a carbon fiber bundle that comprised 24,000 filaments and had a heat conductivity of 55 W/m·K. The three fiber bundles prepared were superposed in a state as shown in FIG. 3. Both the superposed portion of the first precursor fiber bundle FB1 and the carbon fiber bundle JFB, and the superposed portion of the second precursor fiber bundle FB1 and the carbon fiber bundle JFB, had a length of 400 mm. The distance between the end of the first precursor fiber bundle FB1 and the end of the second precursor fiber bundle FB2 was 500 mm.

The fiber bundle joining apparatus shown in FIG. 5 was used to join the first precursor fiber bundle FB1 and the carbon fiber bundle JFB and join the second precursor fiber bundle FB1 and the carbon fiber bundle JFB in the superposed fiber bundle portion. Here, the same three fiber interlacing devices 51 as in Example 1 were used. As in Example 1, the superposed fiber bundles were relaxed by 9.0% in the fiber relaxed apparatus 53 using a round bar.

Subsequently, as in Example 1, air jets compressed at a pressure of 0.4 MPa were applied for 2 seconds from the fluid jetting holes. This produced three fiber joint portions between the first fiber bundle FB1 and the carbon fiber bundle JFB and another three fiber joint portions between the second fiber bundle FB2 and the carbon fiber bundle JFB. Each of the resulting fiber joint portions A had an unraveled fiber portion (heat radiator portion) B and two interlaced fiber portions C. The length X of each unraveled fiber portion (heat radiator portion) B was 42 mm, and the width of the unraveled fiber portion (heat radiator portion) was 1.6 times that of the fiber bundles before unraveling. Each of the interlaced fiber portions C had four tangled sub-portions D. Each tangled fiber portion C had a length Y of 14 mm. Here, the carbon fiber bundle located in the section between the end of the first precursor fiber bundle FB1 and the end of the second precursor fiber bundle FB2 did not receive the compressed air jets.

Table 1 shows results of oxidizing treatment of the continuous fiber bundles having fiber joint portions containing a joint fiber bundle (carbon fiber bundle) prepared in this Example. This continuous fiber bundle showed a passable furnace temperature for the oxidizing furnace that was nearly equal to that of the continuous unprocessed fiber bundle. Consequently, the joint portions were able to pass the oxidizing furnace without decreasing the furnace temperature. The passable process tension was 7 kg/st, indicating that a sufficient binding strength was maintained among the fibers in the joint portions, and the process-passing rate was as high as 100%. After passing process, the joint portions were in good conditions.

Comparative Example 1

The same first fiber bundle FB1 and second fiber bundle FB2 as in Example 1 were superposed. The superposed fiber bundles were subjected to the fiber bundle joining apparatus shown in FIG. 5 to join the two fiber bundles in a superposed fiber bundle portion. Here, three fiber interlacing devices 51 were used. One series of fluid jetting holes was used in each fiber interlacing device 51. The fluid jetting holes had a diameter of 3.0 mm, and the spacing between the fluid jetting holes was 6.0 mm. The superposed first and second fiber bundles FB1 and FB2 were relaxed by 7.0% in the fiber bundle relaxing device 53 using a round bar.

Subsequently, air jets compressed at a pressure of 0.4 MPa were applied for 2 seconds from the fluid jetting holes. This produced three fiber joint portions in the fiber bundles. In each of the resulting fiber joint portions, there was no unraveled fiber portion (heat radiator portion), and one interlaced fiber portion was formed. The resulting interlaced fiber portions had two interlaced sub-portions. The interlaced fiber portion had a length Y of 5 mm.

The continuous fiber bundle having fiber joint portions prepared in this Comparative example can easily burn out in the oxidizing furnace because heat cannot be removed efficiently from the joint portion. Accordingly, the passable furnace temperature in the oxidizing furnace was as high as 240° C., and as seen from Table 1, the passable furnace temperature in the oxidizing furnace was significantly lower than that for the continuous unprocessed fiber bundle. The conditions of fiber interlacement vary largely in each interlaced sub-portion, resulting in a low passable process tension of 5 kg/st and an undesirable process passing rate of 80%.

TABLE 1

| | Unraveled fiber portion (heat radiator portion) | Joint fiber bundle | Passable furnace temperature (° C.) | Passable process tension at 245° C. or below (kg/st) | Process passing rate (%) |
|---|---|---|---|---|---|
| Continuous unprocessed fiber bundle | — | — | 258 | 8 | — |
| Example 1 | Existing | | 250 | 7 | 95 |
| Example 2 | Existing | Carbon fiber bundle | 258 | 7 | 100 |
| Comparative example 1 | Absent | | 240 | 5 | 80 |

The conditions adopted in the examples described below are somewhat different from those in the above examples.

As a requirement for the oxidizing furnace, air was fed into the furnace at a flow rate of 1.0 m/sec in the direction perpendicular to the traveling direction of the precursor fiber bundle so that a tension of 1.5 g/tex would be applied to the fiber bundle traveling in the furnace. The upper limit of the temperature range where the fiber joint portion was able to pass through the oxidizing furnace was measured.

The precursor fiber bundle used comprised virtually untwisted multiple fibers, and each single fiber (i.e. each filament) had a fineness of 1.1 dtex. Specifically, it was a polyacrylonitrile-based precursor fiber bundle comprising 24,000 filaments. Results obtained in each example are listed in Table 2.

Example 3

An end portion of a first precursor fiber bundle FB1 and an end portion of a second precursor fiber bundle FB2, opposed to each other with a spacing, were bridged and joined by a joint fiber bundle JFB, which was a carbon fiber bundle comprising 48,000, 24,000, or 12,000 filaments to prepare three fiber-joint-portion-containing fiber bundle samples. In joining the superposed fiber bundles, the fiber bundles were superposed first, and relaxed by 9.0% in their length direction, and subsequently three fiber interlacing devices 51 were used to join the fiber bundles in the superposed portion. Each fiber interlacing device 51 had a first fluid jetting hole series 71 and a second fluid jetting hole series 72. From the fluid jetting holes located at intervals to form each fluid jetting hole series, air jets compressed at a pressure of 0.4 MPa were emitted for two seconds to interlace the multiple fibers in each fiber bundle in the superposed portion. This produced a fiber-joint-portion-containing fiber bundle 3 shown in FIG. 3 that had three fiber joint portions A in each superposed portion. Each fiber joint portion A comprised two interlaced fiber portions C separated from each other and an unraveled fiber portion (heat radiator portion) located between the two interlaced fiber portions C.

As seen from Table 2, for all fiber bundle samples of (a), (b), and (c), the passable furnace temperature for the oxidizing furnace decreased only 0 to 1° C. as compared with the continuous unprocessed fiber bundle used in the Reference example that was free from a joint portion to join the fiber bundles. Thus, there was only a small drop in the passable furnace temperature for the joint portion passing through the oxidizing furnace. The joint-portion-containing fiber bundle samples (a), (b), and (c) were fed to the other steps following the oxidizing furnace, and it was found that none of them were broken by the accumulated heat or process tension not only in the oxidizing step but also in all the subsequent steps including the carbonizing step until the fiber bundles finally was taken up on a bobbin mounted in a winder. Consequently, no changes in the production conditions were required for successfully joining the front end portion of a new fiber bundle with the tail end portion of the fiber bundle previously fed to the calcination step, leading to a significant improvement in the efficiency of carbon fiber production.

Example 4

In this Example, calcination of a fiber bundle was carried out according to the same procedure as in Example 3 (b) except that a carbon fiber bundle as shown in Table 2 was used as joint fiber bundle. As a result, the passable furnace temperature in the oxidizing furnace was found to be 3° C. lower than in Reference example, and some fibers were broken by the tension received in the carbonizing step, but it was confirmed that the sample served sufficiently for the production of carbon fiber.

Example 5

In this Example, calcination of a fiber bundle was carried out according to the same procedure as in Example 3 (a) except that only one joint portion was formed as shown in FIG. 2. As a result, the passable furnace temperature in the oxidizing furnace was found to be 4° C. lower than in Reference example, and some fibers were broken by the tension received in the carbonizing step, but it was confirmed that the sample served sufficiently for the production of carbon fiber.

Example 6

Calcination of a fiber bundle was carried out according to the same procedure as in Example 3 except that a carbon fiber bundle as shown in Table 2 was used as joint fiber bundle and that the fineness ratio of the precursor fiber bundles FB1 and FB2 to the carbon fiber bundle JFB was adjusted to 3.09. As a result, the passable furnace temperature in the oxidizing furnace was found to be 5° C. lower for both bundles than in Reference example, and some fibers were broken in the carbonizing step, but it was confirmed that the sample served for the production of carbon fiber.

Example 7

Calcination of a fiber bundle was carried out according to the same procedure as in Example 3 except that a carbon fiber bundle as shown in Table 2 was used as joint fiber bundle and that the fineness ratio of the precursor fiber bundles FB1 and FB2 to the carbon fiber bundle JFB was adjusted to 0.15. As a result, the passable furnace temperature in the oxidizing furnace was found to be 5° C. lower for both bundles than in Reference example, and some fibers were broken in the carbonizing step, but it was confirmed that the sample served for the production of carbon fiber.

Example 8

In this Example, the drape value was 20 cm, which was outside the preferable drape value range of 2 to 15 cm for a carbon fiber bundle used as joint fiber bundle. Calcination of a fiber bundle was carried out according to the same procedure as in Example 3 (b) except that the carbon fiber bundle had a drape value of 20 cm. Being high in the drape value, the carbon fiber bundle was stiff, and its multiple fibers did not spread appropriately. Accordingly, as compared with Example 3 (b), the fibers failed to be interlaced sufficiently with those in the precursor fiber bundle, and the tensile strength of the joint portion was low. As a result, the upper limit of the passable temperature range in the oxidizing furnace was 253° C.

Example 9

In this Example, the drape value was 1 cm, which was outside the preferable drape value range of 2 to 15 cm for a carbon fiber bundle used as joint fiber bundle. Calcination of a fiber bundle was carried out according to the same procedure as in Example 3 (b) except that the carbon fiber bundle had a drape value of 1 cm. As a result, as the carbon fiber bundle used as joint fiber bundle had a low drape value, the fiber bundle was unraveled excessively, and its handleability deteriorated, leading to an increase in the time required for the operation. The upper limit of the passable temperature range in the oxidizing furnace was 254° C., indicating that its drop was not significant.

Example 10

In this Example, the flatness was 14, which was outside the preferable flatness range of 20 or more cm for a carbon fiber bundle used as joint fiber bundle. Calcination of a fiber bundle was carried out according to the same procedure as in Example 3 (b) except that the carbon fiber bundle had a flatness of 14. Consequently, as in Example 8, the multiple fibers in the carbon fiber bundle did not spread appropriately. Accordingly, as compared with Example 3 (b), the fibers failed to be interlaced sufficiently with those in the precursor fiber bundle, and the tensile strength of the joint portion was low. As a result, the upper limit of the passable temperature range in the oxidizing furnace was 253° C.

Example 11

In this Example, the heat conductivity was 1 W/m·K, which was outside the preferable heat conductivity range of 3 to 700 W/m·K for joint fiber bundles. Calcination of a fiber bundle was carried out according to the same procedure as in Example 3 except that an oxidized fiber bundle comprising 24,000 filaments was used as the joint fiber bundle having a heat conductivity of 1 W/m·K. As the heat conductivity of the joint fiber bundle was low, heat was not radiated sufficiently from the joint portion in the oxidizing furnace, leading to easy breakage of the yarn due to heat accumulation. As a result, the upper limit of the passable temperature range in the oxidizing furnace was 252° C.

TABLE 2

| | 1st and 2nd precursor fiber bundle | Joint fiber bundle | | | | |
|---|---|---|---|---|---|---|
| | Number of filaments number | Number of filaments number | Drape value cm | Heat conductivity W/m · K | Flatness — | Fineness ratio — |
| Reference example | 24,000 | no fiber joint portion | | | | |
| Example 3 (a) | 24,000 | 48,000 | 8 | 10 | 52 | 1.24 |
| Example 3 (b) | 24,000 | 24,000 | 8 | 10 | 62 | 0.62 |
| Example 3 (c) | 24,000 | 12,000 | 7 | 10 | 70 | 0.30 |
| Example 4 | 24,000 | 24,000 | 8 | 7 | 63 | 0.38 |
| Example 5 | 24,000 | 48,000 | 8 | 10 | 52 | 1.24 |
| Example 6 | 24,000 | 120,000 | 8 | 10 | 48 | 3.09 |
| Example 7 | 24,000 | 6,000 | 8 | 10 | 72 | 0.15 |
| Example 8 | 24,000 | 24,000 | 20 | 10 | 69 | 0.62 |
| Example 9 | 24,000 | 24,000 | 1 | 10 | 62 | 0.62 |
| Example 10 | 24,000 | 24,000 | 13 | 10 | 14 | 0.62 |
| Example 11 | 24,000 | 24,000 | 9 | 1 | 86 | 0.83 |

| | Fiber joint portion | | | Oxidizing step | Carbonizing step |
|---|---|---|---|---|---|
| | Tensile strength g/tex | Number of joint portions number | Number of interlaced sub-portion number | Upper limit of passable temperature ° C. | Furnace passing conditions % |
| Reference example | no fiber joint portion | | | 260 | Excellent |

TABLE 2-continued

| | | | | | |
|---|---|---|---|---|---|
| Example 3 (a) | 35 | 4 | 4 | 259 | Excellent |
| Example 3 (b) | 35 | 4 | 4 | 260 | Excellent |
| Example 3 (c) | 26 | 4 | 4 | 259 | Excellent |
| Example 4 | 33 | 4 | 3 | 257 | Good |
| Example 5 | 24 | 1 | 3 | 256 | Good |
| Example 6 | 35 | 4 | 5 | 255 | Good |
| Example 7 | 20 | 4 | 5 | 255 | Good |
| Example 8 | 13 | 4 | 2 | 253 | Good |
| Example 9 | 14 | 4 | 3 | 254 | Good |
| Example 10 | 15 | 4 | 3 | 253 | Good |
| Example 11 | 18 | 4 | 3 | 252 | Good |

When subjected to continuous calcination in a calcination step, a fiber-joint-portion-containing fiber bundle according to embodiments of the invention does not suffer breakage of fiber bundle or slippage of fibers of the fiber bundle out of the fiber bundle during the calcination step, serving to prevent heat accumulation in a fiber joint portion and efficiently achieve heat removal from the fiber joint portion. Consequently, the fiber-joint-portion-containing fiber bundle according to embodiments of the invention can be passed continuously through the calcination step at a temperature that is not significantly lower than the furnace temperatures of calcination steps commonly used for fiber bundles free from fiber joint portions or for the portions other than the fiber joint portions of fiber-joint-portion-containing fiber bundles, allowing calcined fibers, such as carbon fiber, to be produced continuously through prolonged implementation of a calcination step with high operating efficiency. As a result, the productivity for calcined fibers, such as carbon fiber, can be improved largely.

REFERENCE SIGNS LIST

1: fiber-joint-portion-containing fiber bundle
2: fiber-joint-portion-containing fiber bundle
3: fiber-joint-portion-containing fiber bundle
4*a*: one end portion
4*b*: the other end portion
5: end portion (tail end portion)
6: end portion (front end portion)
50: fiber bundle joining apparatus
51: fiber interlacing device
51*a*: upper fiber interlacing device
51*b*: lower fiber interlacing device
52: fiber bundle clamping device
53: fiber bundle relaxing device
71: first fluid jetting hole series
72: second fluid jetting hole series
90: drape property test sample preparing apparatus
91: sample fixing apparatus
92: test sample
93: weight
100: drape value measuring apparatus
101: base
102: square pillar
103: flat plate
A: fiber joint portion
B: fiber unraveled portion
C: fiber interlaced portion
D: interlaced sub-portion
DL: length of the portion of a drape value test piece protruding from the square pillar
FB1: first fiber bundle
FB2: second fiber bundle
FC: pressurized fluid chamber
FS: pressurized fluid supply path
H: heat
HD: fluid jetting hole diameter
HR: heat radiation
JFB: joint fiber bundle (carbon fiber bundle)
L: length of fiber bundles between two adjacent fluid jetting hole series measured in the length direction (spacing between two series of holes)
Ld: drape value (distance)
P: spacing between fluid jetting holes
SL: length of drape value test sample
TL: length of drape value test piece
TP: drape value test piece
X: length of unraveled fiber portion in the length direction of fiber bundles
Y: length of interlaced fiber portion in the length direction of fiber bundles

The invention claimed is:

1. A production method for a fiber bundle having a fiber joint portion comprising applying a pressurized fluid emitted from a fiber interlacing apparatus to each of superposed fiber bundle portions in a fiber bundle that has either a superposed fiber bundle portion in which one end portion of a first fiber bundle of multiple fibers and one end portion of a second fiber bundle of multiple fibers are superposed or two superposed fiber bundle portions formed in a joint fiber bundle where one end portion of a first fiber bundle of multiple fibers and one end portion of a second fiber bundle of multiple fibers are respectively superposed on said joint fiber bundle, so that said fibers are interlaced with each other to join said fiber bundles in said superposed fiber bundle portions; wherein said fiber interlacing apparatus comprises a first fluid jetting hole series comprising a plurality of fluid jetting holes aligned at intervals along a first line in the width direction of said fiber bundles and a second fluid jetting hole series comprising a plurality of fluid jetting holes aligned at intervals along a second line that is parallel to the first line and that is positioned with an interval in the length direction of said fiber bundles to the first line, said first line and said second line are separated by 20 to 100 mm, and the fluid jetting holes in said first fluid jetting hole series and said second fluid jetting hole series are aligned at intervals of 1.7 to 4.5 mm, and works to emit pressurized fluid jets from said plurality of fluid jetting holes of said first fluid jetting hole series and said plurality of fluid jetting holes of said second fluid jetting hole series to produce, in said superposed fiber bundle portion, two or more interlaced fiber portions in which said fibers are interlaced and that are located apart from each other in the length direction of the fiber bundles and an unraveled fiber portion in which said fibers are unraveled and that is located between said two or more interlaced fiber portions, in such a manner that each of said interlaced fiber portions is composed of two or more interlaced sub-portions that are composed of said multiple fibers of one fiber bundle and said multiple fibers of the other fiber bundle interlaced in said superposed fiber bundle portion and that are located at intervals in the width direction of said fiber bundles, so that said fiber bundles are joined together in said superposed fiber bundle portion.

2. The production method for a fiber bundle according to claim 1, wherein both said first fiber bundle and said second fiber bundle are a precursor fiber bundle designed for carbon fiber production.

3. The production method for a fiber bundle according to claim 2, wherein said joint fiber bundle has a heat conductivity of 3 to 700 W/m·K.

4. The production method for a fiber bundle according to claim 3, wherein said joint fiber bundle is a carbon fiber bundle having a drape value of 2 to 15 cm and a flatness of 20 or more.

5. The production method for a fiber bundle according to claim 4, wherein the fineness of said joint fiber bundle is 0.2 to 3.0 times that of said first fiber bundle and that of said second fiber bundle.

6. The production method for a fiber bundle according to claim 4, wherein said fiber joint portion has a tensile strength of 20 g/tex or more at room temperature.

7. A carbon fiber production method comprising the steps of producing a fiber bundle by the production method for a fiber bundle according to claim 4, and thereafter, passing the fiber bundle continuously through an oxidizing furnace and then a carbonizing furnace to produce a carbon fiber.

8. A production method for a fiber bundle having a fiber joint portion comprising applying a pressurized fluid emitted from a fiber interlacing apparatus to each of superposed fiber bundle portions in a fiber bundle that has either a superposed fiber bundle portion in which one end portion of a first fiber bundle of multiple fibers and one end portion of a second fiber bundle of multiple fibers are superposed or two superposed fiber bundle portions formed in a joint fiber bundle where one end portion of a first fiber bundle of multiple fibers and one end portion of a second fiber bundle of multiple fibers are respectively superposed on said joint fiber bundle, so that said fibers are interlaced with each other to join said fiber bundles in said superposed fiber bundle portions; wherein said fiber interlacing apparatus comprises a first fluid jetting hole series comprising a plurality of fluid jetting holes aligned at intervals along a first line in the width direction of said fiber bundles and a second fluid jetting hole series comprising a plurality of fluid jetting holes aligned at intervals along a second line that is parallel to the first line and that is positioned with an interval in the length direction of said fiber bundles to the first line, the plurality of fluid jetting holes in said first fluid jetting hole series and the plurality of fluid jetting holes in said second fluid jetting hole series are aligned so that the respective intervals in the width direction of said fiber bundles become equal to each other, and works to emit pressurized fluid jets from said plurality of fluid jetting holes of said first fluid jetting hole series and said plurality of fluid jetting holes of said second fluid jetting hole series to produce, in said superposed fiber bundle portion, two or more interlaced fiber portions in which said fibers are interlaced and that are located apart from each other in the length direction of the fiber bundles and an unraveled fiber portion in which said fibers are unraveled and that is located between said two or more interlaced fiber portions, in such a manner that each of said interlaced fiber portions is composed of two or more interlaced sub-portions that are composed of said multiple fibers of one fiber bundle and said multiple fibers of the other fiber bundle interlaced in said superposed fiber bundle portion and that are located at intervals in the width direction of said fiber bundles, so that said fiber bundles are joined together in said superposed fiber bundle portion.

9. The production method for a fiber bundle according to claim 8, wherein said first line and said second line are separated by 20 to 100 mm, and the fluid jetting holes in said first fluid jetting hole series and said second fluid jetting hole series are aligned at intervals of 1.7 to 4.5 mm.

* * * * *